US010849357B2

(12) United States Patent
Roudier et al.

(10) Patent No.: US 10,849,357 B2
(45) Date of Patent: Dec. 1, 2020

(54) SMOKING ARTICLE INCLUDING DUAL HEAT-CONDUCTING ELEMENTS

(71) Applicant: Philip Morris Products S.A., Neuchatel (CH)

(72) Inventors: Stephane Roudier, Colombier (CH); Aleksandra Samulewicz, Budapest (HU); Frederic Lavanchy, Grandson (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 14/378,220

(22) PCT Filed: Feb. 12, 2013

(86) PCT No.: PCT/EP2013/052786
§ 371 (c)(1),
(2) Date: Aug. 12, 2014

(87) PCT Pub. No.: WO2013/120849
PCT Pub. Date: Aug. 22, 2013

(65) Prior Publication Data

US 2015/0053219 A1 Feb. 26, 2015

(30) Foreign Application Priority Data

Feb. 13, 2012 (EP) ..... 12155234

(51) Int. Cl.
*A24F 47/00* (2020.01)
*A24D 1/22* (2020.01)

(52) U.S. Cl.
CPC ..... *A24F 47/008* (2013.01); *A24D 1/22* (2020.01); *A24F 47/006* (2013.01)

(58) Field of Classification Search
CPC ..... A24F 47/004; A24F 47/006
See application file for complete search history.

(56) References Cited

U.S. PATENT DOCUMENTS 4,714,082 A 12/1987 Banerjee et al.
4,793,365 A * 12/1988 Sensabaugh, Jr. ... A24B 15/165 128/202.21

(Continued)

FOREIGN PATENT DOCUMENTS

CN 86 1 05536 A 2/1987
CN 1051492 A 5/1991

(Continued)

OTHER PUBLICATIONS

Written Opinion dated May 19, 2015 in Singapore Patent Application No. 11201404866 U.

(Continued)

*Primary Examiner* — Eric Yaary
(74) *Attorney, Agent, or Firm* — Oblon, McClelland, Maier & Neustadt, L.L.P.

(57) ABSTRACT

A smoking article is provided, including a heat source; an aerosol-forming substrate downstream of the heat source; a first heat-conducting element around and in contact with a rear portion of the heat source and an adjacent front portion of the aerosol-forming substrate; and a second heat-conducting element around at least a portion of the first heat-conducting element. At least part of the second heat-conducting element is radially separated from the first heat-conducting element; and, preferably, the first and second heat-conducting elements are separated by an outer paper wrapper.

16 Claims, 1 Drawing Sheet

(56) References Cited

U.S. PATENT DOCUMENTS

| | | | | |
|---|---|---|---|---|
| 4,819,665 | A * | 4/1989 | Roberts | A24F 47/004 131/195 |
| 4,928,714 | A | 5/1990 | Shannon | |
| 4,966,171 | A * | 10/1990 | Serrano | A24F 47/004 131/194 |
| 5,020,548 | A | 6/1991 | Farrier et al. | |
| 5,024,242 | A * | 6/1991 | Garthaffner | A24C 5/00 131/280 |
| 5,027,837 | A | 7/1991 | Clearman et al. | |
| 5,119,834 | A | 6/1992 | Shannon et al. | |
| 5,240,012 | A * | 8/1993 | Ehrman | A24B 15/165 131/182 |
| 7,753,056 | B2 | 7/2010 | Borschke et al. | |
| 2008/0149118 | A1* | 6/2008 | Oglesby | A61M 11/047 131/194 |
| 2009/0065011 | A1 | 3/2009 | Maeder et al. | |
| 2011/0088707 | A1* | 4/2011 | Hajaligol | A24B 15/165 131/194 |
| 2011/0180082 | A1 | 7/2011 | Banerjee et al. | |
| 2012/0067360 | A1 | 3/2012 | Conner et al. | |
| 2013/0019888 | A1* | 1/2013 | Tsuruizumi | A24B 15/165 131/331 |
| 2013/0133675 | A1* | 5/2013 | Shinozaki | A24F 47/008 131/329 |

FOREIGN PATENT DOCUMENTS

| | | | | |
|---|---|---|---|---|
| CN | 1059841 | A | 4/1992 | |
| CN | 1023059 | C | 12/1993 | |
| CN | 1607911 | A | 4/2005 | |
| CN | 101778578 | A | 7/2010 | |
| DE | 283 328 | A5 | 10/1990 | |
| EP | 0 245 732 | A2 | 11/1987 | |
| EP | 0 336 456 | A2 | 10/1989 | |
| EP | 0 336 458 | A2 | 10/1989 | |
| EP | 0 340 808 | | 11/1989 | |
| EP | 0 472 367 | A1 | 2/1992 | |
| EP | 0 535 695 | A2 | 4/1993 | |
| EP | 1 670 326 | B1 | 2/2007 | |
| EP | 2 173 204 | | 4/2010 | |
| EP | 2 550 879 | A1 | 1/2013 | |
| JP | 62-48370 | A | 3/1987 | |
| JP | 3-232481 | A | 10/1991 | |
| JP | 4-258281 | A | 9/1992 | |
| JP | WO 2007/119678 | A1 | 10/2007 | |
| JP | 2010-535530 | A | 11/2010 | |
| JP | WO 2011118024 | A1 * | 9/2011 | A24B 15/165 |
| JP | WO 2012014490 | A1 * | 2/2012 | A24F 47/006 |
| RU | 2 102 906 | C1 | 1/1998 | |
| TW | 201134408 | A1 | 10/2011 | |
| UA | 27364 | C2 | 9/2000 | |
| WO | 2009 022232 | | 2/2009 | |
| WO | WO 2011/118024 | A1 | 9/2011 | |
| WO | WO 2011117750 | A2 * | 9/2011 | A24B 15/165 |
| WO | WO 2012/090294 | A1 | 7/2012 | |
| WO | WO2012/090294 | A1 | 7/2012 | |

OTHER PUBLICATIONS

International Search Report dated Jul. 1, 2013 in PCT/EP13/052786 Filed Feb. 12, 2013.

Combined Office Action and Search Report dated Mar. 3, 2016 in Chinese Patent Application No. 201380016430.6 (with English language translation).

Office Action dated Oct. 21, 2015 in Japanese Patent Application No. 2014-557010 (with English translation).

Decision of Grant dated Sep. 6, 2016 in corresponding Russian Patent Application No. 2014137105, with English translation, (11 pages).

Japanese Patent Office Notice of Submission of Third Party Observation, dated Jun. 6, 2016 in corresponding Japanese Patent Application No. 2014-557010, 1 page (no English translation available).

Third Party Observation dated May 27, 2016, included with Notice document at line AW in corresponding Japanese Patent Application No. 2014-557010, 13 pages (no English translation available).

Webpages of the Kyocera Corporation Japanese language website (http://www.kyocera.co.jp/fcworld/charact/heat/thermalcond.html), and corresponding webpages of the Kyocera Corporation English language website (http://global.kyocera.com/fcworld/charact/heat/thermalcond.html), 4 pages.

Russian Decision to Grant dated Jan. 18, 2016 in Russian Patent Appiication No. 2016150118 (with English translation), 12 pages.

Canadian Office Action dated Mar. 8, 2018 in corresponding Canadian Patent Application No. 286437, (6 pages).

Japanese Office Action with English translation dated May 21, 2018 in Japanese Patent Application No. 2017-120362, (4 pages).

Israeli Office Action dated Feb. 26, 2019 in Israeli Patent Application No. 233948 (with English translation), 7 pages.

Japanese Office Action dated Mar. 2, 2020 in Japanese Patent Application No. 2018-211052 (with English translation), 11 pages.

Chinese Office Action and Search Report dated Jul. 15, 2020, issued in Chinese Patent Application No. 201380016430.6 (with English translation).

* cited by examiner

SMOKING ARTICLE INCLUDING DUAL HEAT-CONDUCTING ELEMENTS

CROSS REFERENCE TO RELATED APPLICATION

This application is a national phase application based on PCT/EP2013/052786, filed on Feb. 12, 2013.

The present invention relates to a smoking article comprising a heat source, an aerosol-forming substrate downstream of the heat source and dual heat-conducting elements provided around the smoking article.

A number of smoking articles in which tobacco is heated rather than combusted have been proposed in the art. One aim of such 'heated' smoking articles is to reduce known harmful smoke constituents of the type produced by the combustion and pyrolytic degradation of tobacco in conventional cigarettes. In one known type of heated smoking article, an aerosol is generated by the transfer of heat from a combustible heat source to an aerosol-forming substrate located downstream of the combustible heat source. During smoking, volatile compounds are released from the aerosol-forming substrate by heat transfer from the combustible heat source and entrained in air drawn through the smoking article. As the released compounds cool, they condense to form an aerosol that is inhaled by the user. Typically, air is drawn into such known heated smoking articles through one or more airflow channels provided through the combustible heat source and heat transfer from the combustible heat source to the aerosol-forming substrate occurs by convection and conduction.

For example, WO-A-2009/022232 discloses a smoking article comprising a combustible heat source, an aerosol-forming substrate downstream of the combustible heat source, and a heat-conducting element around and in contact with a rear portion of the combustible heat source and an adjacent front portion of the aerosol-forming substrate.

The heat-conducting element in the smoking article of WO-A-2009/022232 transfers the heat generated during combustion of the heat source to the aerosol-forming substrate via conduction. The heat drain exerted by the conductive heat transfer significantly lowers the temperature of the rear portion of the combustible heat source so that the temperature of the rear portion is retained significantly below its self-ignition temperature.

In smoking articles in which tobacco is heated, the temperature attained in the aerosol-forming substrate has a significant impact on the ability to generate a sensorially acceptable aerosol. It is typically desirable to maintain the temperature of the aerosol-forming substrate within a certain range in order to optimise the aerosol delivery to the user. In some cases, radiative heat losses from the outer surface of the heat-conducting element may cause the temperature of the combustible heat source and the aerosol-forming substrate to drop outside of the desired range, thereby impacting the performance of the smoking article. If the temperature of the aerosol-forming substrate drops too low, for instance, it may adversely impact the consistency and the amount of aerosol delivered to the user.

In certain heated smoking articles, convective heat transfer from a combustible heat source to the aerosol-forming substrate is provided in addition to the conductive heat transfer. For example, in some known smoking articles at least one longitudinal airflow channel is provided through the combustible heat source in order to provide convective heating of the aerosol-forming substrate. In such smoking articles, the aerosol-forming substrate is heated by a combination of conductive and convective heating.

In other heated smoking articles it may be preferred to provide a combustible heat source without any airflow channels extending through the heat source. In such smoking articles, there may be limited convective heating of the aerosol-forming substrate and the heating of the aerosol-forming substrate is primarily achieved by the conductive heat transfer from the heat-conducting element. When the aerosol-forming substrate is heated primarily by conductive heat transfer, the temperature of the aerosol-forming substrate can become more sensitive to changes in the temperature of the heat-conducting element. This means that any cooling of the heat-conducting element due to radiative heat loss may have a greater impact on the aerosol generation than in smoking articles where convective heating of the aerosol-forming substrate is also available.

It would be desirable to provide a heated smoking article including a heat source and an aerosol-forming substrate downstream of the heat source which provides improved smoking performance. In particular, it would be desirable to provide a heated smoking article in which there is improved control of the conductive heating of the aerosol-forming substrate in order to help maintain the temperature of the aerosol-forming substrate within the desired temperature range during smoking.

According to the present invention there is provided a smoking article comprising: a heat source; an aerosol-forming substrate downstream of the heat source; a first heat-conducting element around and in direct contact with a rear portion of the heat source and an adjacent front portion of the aerosol-forming substrate; and a second heat-conducting element around at least a portion of the first heat-conducting element. At least part of the second heat-conducting element is radially separated from the first heat-conducting element.

As used herein, the terms "upstream", "front", "downstream" and "rear" are used to describe the relative positions of components or portions of components of smoking articles of the invention in relation to the direction in which a user draws on the smoking articles during use.

Smoking articles of the invention comprise a mouth end and an opposed distal end. In use, a user draws on the mouth end of the smoking article. The mouth end is downstream of the distal end. The heat source is located at or proximate to the distal end.

The rear portion of the heat source is the portion that is circumscribed by and in direct contact with the first heat-conducting element.

The front portion of the aerosol-forming substrate is the portion that is circumscribed by and in direct contact with the first heat-conducting element.

As used herein, the term "length" is used to describe the dimension in the longitudinal direction of the smoking article.

As used herein, the term "direct contact" is used to mean contact between two components without any intermediate connecting material, such that the surfaces of the components are touching each other.

As used herein, the term "radially separated" is used to indicate that at least a part of the second heat-conducting element is spaced apart from the underlying first heat-conducting element in a radial direction, such that there is no direct contact between that part of the second heat-conducting element and the first heat-conducting element.

The smoking article of the present invention incorporates a second heat-conducting element that overlies at least a portion of the first heat-conducting element. There is radial separation between the first and second heat-conducting elements at one or more positions on the smoking article.

Preferably, all or substantially all of the second heat-conducting element is radially separated from the first heat-conducting element, such that there is substantially no direct contact between the first and second heat-conducting elements to limit or inhibit the conductive transfer of heat from the first heat-conducting element to the second heat-conducting element. The transfer of heat from the first heat-conducting element to the second heat-conducting element is therefore preferably limited to radiative heat transfer. As a result, the second heat-conducting element retains a lower temperature than the first heat-conducting element. The radiative losses of heat from the outer surfaces of the smoking article are reduced compared to a smoking article which does not have a second heat-conducting element around at least a portion of the first heat-conducting element.

The second heat-conducting element advantageously reduces the heat losses from the first heat-conducting element. The second heat-conducting element is formed of a heat conductive material which will increase in temperature during smoking of the smoking article, as heat is generated by the heat source. The increased temperature of the second heat-conducting element reduces the temperature differential between the first heat-conducting element and the overlying material such that the loss of heat from the first heat-conducting element can be reduced.

By reducing the heat losses from the first heat-conducting element, the second heat-conducting element advantageously helps to better maintain the temperature of the first heat-conducting element within the desired temperature range. The second heat-conducting element advantageously helps to more effectively use the heat from the heat source to warm the aerosol-forming substrate to the desired temperature range. In a further advantage, the second heat-conducting element helps maintain the temperature of the aerosol-forming substrate at a higher level. The second heat-conducting element in turn improves the generation of aerosol from the aerosol-forming substrate. Advantageously, the second heat-conducting element increases the overall delivery of aerosol to the user. In particular, it can be seen that the nicotine delivery can be significantly improved through the addition of the second heat-conducting element.

In addition, the second heat-conducting element has been found to advantageously extend the smoking duration for the smoking article so that a greater number of puffs can be taken.

In some preferred embodiments, the second heat-conducting element conducts heat along the smoking article from the heat source in the same way as the first heat-conducting element. The second heat-conducting element may therefore, in such embodiments, also improve the efficiency of the heat conduction from the heat source to the aerosol-forming substrate and therefore the heating of the aerosol-forming substrate.

The improvement to the conductive heat transfer achieved through the inclusion of a second heat-conducting element is particularly beneficial for smoking articles in which there is minimal convective heat transfer.

The radial separation between the first and second heat-conducting elements is preferably achieved through the inclusion of one or more intermediate layers between the first and second heat-conducting elements. The one or more intermediate layers may be provided over the entire area in which the second heat-conducting element overlies the first heat-conducting element. Alternatively, the one or more intermediate layers may be provided in only part or parts of this area. The one or more intermediate layers may in some cases extend beyond the first and second heat-conducting elements, for example, along the smoking article beyond the first and second heat-conducting element in a downstream or upstream direction.

Preferably, the first and second heat-conducting elements are radially separated by one or more layers of a heat insulative material, such as paper. For example, in one preferred embodiment of the invention, the first heat-conducting element is covered by a paper wrapper that circumscribes the smoking article along at least a portion of its length. The circumscribing paper wrapper advantageously provides complete separation of the first and second heat-conducting elements such that there is no direct contact between the surfaces of the heat-conducting elements.

Particularly preferably, the first and second heat-conducting elements are separated by an outer wrapper of the smoking article, which circumscribes the smoking article along its length. In such embodiments, the outer wrapper is wrapped around the smoking article over the first heat-conducting element, and the second heat-conducting element is then applied on top of at least a portion of the outer wrapper. The second heat-conducting element may therefore be provided at the outside of the smoking article, such that the second heat-conducting element is visible on the external surface of the smoking article. Alternatively, an additional wrapper may be provided over the second heat-conducting element to provide the external surface of the smoking article. The additional wrapper may extend along all or just a part of the smoking article The provision of the second heat-conducting element over the outer wrapper provides further benefits in relation to the appearance of the smoking articles according to the invention, and in particular, the appearance of the smoking article during and after smoking. In certain cases, some discolouration of the outer wrapper in the region of the heat source is observed when the wrapper is exposed to heat from the heat source. The outer wrapper may additionally be stained as a result of the migration of the aerosol former from the aerosol-forming substrate into the outer wrapper. In smoking articles according to the invention, the second heat-conducting element can be provided over at least a part of the heat source and the adjacent part of the aerosol-forming substrate so that discolouration or staining is covered and no longer visible. The initial appearance of the smoking article can therefore be retained during smoking.

Alternatively or in addition to an intermediate layer of material between the first and second heat-conducting elements, at least a part of the first and second heat-conducting elements may be radially separated by an air gap. An air gap may be provided through the inclusion of one or more spacer elements between the first heat-conducting element and second heat-conducting element to maintain a defined separation from each other. This could be achieved, for example, through the perforation or embossment of the second heat-conducting element. In such embodiments, the embossed parts of the second heat-conducting element may be in contact with the first heat-conducting element whilst the non-embossed parts are separated from the first heat-conducting element by means of an air gap, or vice versa. Alternatively, one or more separate spacer elements could be provided between the heat-conducting elements.

Preferably, the first and second heat-conducting elements are radially separated from each other by at least 50 microns, more preferably by at least 75 microns and most preferably by at least 100 microns. Where one or more intermediate layers are provided between the heat-conducting elements, as described above, the radial separation of the heat-conducting elements will be determined by the thickness of the one or more intermediate layers.

As described above, the first heat-conducting element of smoking articles according to the invention is in contact with a rear portion of the heat source and an adjacent front portion of the aerosol-forming substrate. In embodiments with a combustible heat source, the heat-conducting element is preferably combustion resistant and oxygen restricting.

In particularly preferred embodiments of the invention, the first heat-conducting element forms a continuous sleeve that tightly circumscribes the rear portion of the heat source and the front portion of the aerosol-forming substrate.

Preferably, the first heat-conducting element provides a substantially airtight connection between the heat source and the aerosol-forming substrate. This advantageously prevents combustion gases from the heat source being readily drawn into the aerosol-forming substrate through its periphery. Such a connection also minimises or substantially avoids convective heat transfer from the heat source to the aerosol-forming substrate by hot air drawn along the periphery.

The first heat-conducting element may be formed of any suitable heat-resistant material or combination of materials with an appropriate thermal conductivity. Preferably, the first heat-conducting element is formed from material having a bulk thermal conductivity of between about 10 W per metre Kelvin (W/(m·K)) and about 500 W per metre Kelvin (W/(m·K)), more preferably between about 15 W/m·K and about 400 W/m·K, at 23° C. and a relative humidity of 50% as measured using the modified transient plane source (MTPS) method.

Suitable first heat-conducting elements for use in smoking articles according to the invention include, but are not limited to: metal foil wrappers such as, for example, aluminium foil wrappers, steel wrappers, iron foil wrappers and copper foil wrappers; and metal alloy foil wrappers.

Preferably the thickness of the first heat-conducting element is between about 5 microns and about 50 microns, more preferably between about 10 microns and about 30 microns and most preferably about 20 microns. In particularly preferred embodiments of the invention, the first heat-conducting element is formed of an aluminium foil having a thickness of about 20 microns.

Preferably, the rear portion of the heat source surrounded by the first heat-conducting element is between about 2 mm and about 8 mm in length, more preferably between about 3 mm and about 5 mm in length.

Preferably, the front portion of the heat source not surrounded by the first heat-conducting element is between about 5 mm and about 15 mm in length, more preferably between about 6 mm and about 8 mm in length.

Preferably, the aerosol-forming substrate extends at least about 3 mm downstream beyond the first heat-conducting element. In other embodiments, the aerosol-forming substrate may extend less than 3 mm downstream beyond the first heat-conducting element. In yet further embodiments, the entire length of the aerosol-forming substrate may be surrounded by the first heat-conducting element.

The second heat-conducting element is provided over at least a part of the first heat-conducting element and may extend around all or a part of the circumference of the smoking article. Preferably, the second heat-conducting element is in the form of a continuous sleeve circumscribing the smoking article, over a portion of at least the first heat-conducting element.

The second heat-conducting element may be formed of any suitable heat-resistant material or combination of materials with an appropriate thermal conductivity. Preferably, the second heat-conducting element is formed from material having a bulk thermal conductivity of between about 10 W per metre Kelvin (W/(m·K)) and about 500 W per metre Kelvin (W/(m·K)), more preferably between about 15 W per metre Kelvin (W/(m·K)) and about 400 W per metre Kelvin (W/(m·K)), at 23° C. and a relative humidity of 50% as measured using the modified transient plane source (MTPS) method.

Suitable second heat-conducting elements for use in smoking articles according to the invention include, but are not limited to: metal foil wrappers such as, for example, aluminium foil wrappers, steel wrappers, iron foil wrappers and copper foil wrappers; and metal alloy foil wrappers. The second heat-conducting element may be formed of the same material as the first heat-conducting element, or a different material. Preferably, the first and second heat-conducting elements are formed of the same material, which is most preferably aluminium foil.

In particularly preferred embodiments of the present invention, the second heat-conducting element comprises a heat-reflective material, such as aluminium or steel. In such embodiments, the second heat-conducting element advantageously reflects some of the heat radiating from the first heat-conducting element back to the first heat-conducting element. This further reduces the heat losses from the first heat-conducting element so that the temperature of the heat-conducting element can be better controlled and the heat source can be retained at a higher temperature.

As used herein the term "heat-reflective material" refers to a material that has a relatively high heat reflectivity and a relatively low heat emissivity such that the material reflects a greater proportion of incident radiation from its surface than it emits. Preferably, the material reflects more than 50% of incident radiation, more preferably more than 70% of incident radiation and most preferably more than 75%.

In embodiments in which the second heat-conducting element comprises a heat-reflective material, preferably all or substantially all of the second heat-conducting element is radially separated from the first heat-conducting element in order to facilitate the reflection of heat towards the first heat-conducting element.

The reflectivity of the second heat-conducting element may be improved by providing a shiny inner surface, wherein the inner surface is the surface of the second heat-conducting element that faces the outer surface of the first heat-conducting element.

In certain preferred embodiments, the second heat-conducting element may be formed of a single layer of a heat-conducting material, such as aluminium. Alternatively, the second heat-conducting element may be formed of a multilayer or laminate material, comprising at least one layer of a heat-conducting material in combination with one or more other conducting or non-conducting layers. The heat-conducting layer may be formed of any of the materials indicated above. In certain embodiments, the second heat-conducting element may be formed of a laminate material including at least one heat-conducting layer and at least one heat-insulating layer, wherein the second heat-conducting element is provided with the heat-insulating layer forming the inner layer, between the heat-conducting elements. In this way, the heat-insulating layer of the laminate provides the desired radial separation of the heat-conducting elements. Additional outer layers may be provided over the heat-conducting layer, if desired. For example, an outer layer of paper may be provided over the heat-conducting layer for aesthetic reasons.

The use of a laminate material to provide the second heat-conducting element may additionally be beneficial during the production of the smoking articles according to the invention, since the heat-insulating layer may provide added strength and rigidity. This enables the material to be processed more easily, with a reduced risk of collapse or breakage of the heat-conducting layer, which may be relatively thin and fragile.

One example of a particularly suitable laminate material for forming the second heat-conducting element is a double layer laminate, which includes an outer layer of aluminium and an inner layer of paper.

Preferably the thickness of the second heat-conducting element is between about 5 microns and about 50 microns, more preferably between about 10 microns and about 30 microns and most preferably about 20 microns. The thickness of the second heat-conducting element may be substantially the same as the thickness of the first heat-conducting element, or the heat-conducting elements may have a different thickness to each other. Preferably, both the first and second heat-conducting elements are formed of an aluminium foil having a thickness of about 20 microns.

The position and coverage of the second heat-conducting element may be adjusted relative to the first heat-conducting element and the underlying heat source and aerosol-forming substrate in order to control heating of the smoking article during smoking. The second heat-conducting element may be positioned over at least a part of the aerosol-forming substrate. Alternatively or in addition, the second heat-conducting element may be positioned over at least a part of the heat source. More preferably, the second heat-conducting element is provided over both a part of the aerosol-forming substrate and a part of the heat source, in a similar way to the first heat-conducting element.

The extent of the second heat-conducting element in relation to the first heat-conducting element in the upstream and downstream directions may be adjusted depending on the desired performance of the smoking article.

The second heat-conducting element may cover substantially the same area of the smoking article as the first heat-conducting element so that the heat-conducting elements extend along the same length of the smoking article. In this case, the second heat-conducting element preferably directly overlies the first heat-conducting element and fully covers the first heat-conducting element.

Alternatively, the second heat-conducting element may extend beyond the first heat-conducting element in the upstream direction, the downstream direction, or both the upstream and the downstream direction. Alternatively or in addition, the first heat-conducting element may extend beyond the second heat-conducting element in at least one of the upstream and downstream direction.

Preferably, the second heat-conducting element does not extend beyond the first heat-conducting element in the upstream direction. The second heat-conducting element may extend to approximately the same position on the heat source as the first heat-conducting element, such that the first and second heat-conducting elements are substantially aligned over the heat source. Alternatively, the first heat-conducting element may extend beyond the second heat-conducting element in an upstream direction. This arrangement may reduce the temperature of the heat source.

Preferably, the second heat-conducting element extends to at least the same position as the first heat-conducting element in the downstream direction. The second heat-conducting element may extend to approximately the same position on the aerosol-forming substrate as the first heat-conducting element such that the first and second heat-conducting elements are substantially aligned over the aerosol-forming substrate. Alternatively, the second heat-conducting element may extend beyond the first heat-conducting element in the downstream direction so that the second heat-conducting element covers the aerosol-forming substrate over a larger proportion of its length that then the first heat-conducting element. For example, the second heat-conducting element may extend by at least 1 mm beyond the first heat-conducting element, or at least 2 mm beyond the first heat-conducting element. Preferably however, the aerosol-forming substrate extends at least 2 mm downstream beyond the second heat-conducting element so that a rear portion of the aerosol-forming substrate remains uncovered by both heat-conducting elements.

It has surprisingly been found that the extent of the second heat-conducting element relative to the first heat-conducting element on the aerosol-forming substrate has a significant impact on the smoking performance of the smoking article. The coverage of the second heat-conducting element over the aerosol-forming substrate can therefore be adjusted in order to adjust the aerosol delivery profile of the smoking article.

In particular, it has been found that when the second heat-conducting element extends beyond the first heat-conducting element in a downstream direction, a more consistent puff-by-puff delivery of aerosol is provided during smoking. In particular, the aerosol delivery during the middle puffs is found to be reduced, thereby reducing the smoking intensity during these puffs in order to bring it more into line with the intensity at the start and end of smoking. It has also been found that the smoking duration is further increased.

When the second heat-conducting element extends beyond the first heat-conducting element over the aerosol-forming substrate, a larger area of the aerosol-forming substrate is covered by the second heat-conducting element. The heat is thereby dispersed through a greater volume of the aerosol-forming substrate, such that there is less of a temperature differential between different parts of the aerosol-forming substrate. This results in a decrease in the temperature of the front portion of the aerosol-forming substrate and an increase in the temperature of the downstream portions of the aerosol-forming substrate. It is believed that this is responsible for the observed effect on the puff-by-puff delivery of aerosol.

It has further been observed that adjustment of the extension of the second heat-conducting element beyond the first heat-conducting element in the downstream direction changes the time to the first puff of the smoking article. In particular, the time to first puff will be increased by increasing the extension of the second heat-conducting element beyond the first heat-conducting element in the downstream direction.

According to the invention there is further provided a method of adjusting the puff-by-puff aerosol delivery of a smoking article during puffing, the method comprising providing a smoking article according to the invention, as described above, and adjusting the amount by which the second heat-conducting element extends beyond the first heat-conducting element in a downstream direction, over the aerosol-forming substrate.

As used herein, the term "puff-by-puff aerosol delivery" refers to the profile of the amount of aerosol delivered to the user during each subsequent puff taken on the smoking article. For a typical heated smoking article, the profile is in the form of a bell-shaped curve, with the amount of aerosol delivered increasing towards the middle puffs, before decreasing again towards the end of the smoking. The puff-by-puff aerosol delivery can be adjusted so that the actual amount of aerosol delivered to the user in each puff can be modified. Alternatively or in addition, the relative amounts delivered for each puff can be changed, so that the shape of the profile is changed.

In smoking articles according to the invention, heat is generated through a heat source. The heat source may be, for example, a heat sink, a chemical heat source, a combustible heat source, or an electrical heat source. The heat source is preferably a combustible heat source, and comprises any suitable combustible fuel, including but not limited to carbon, aluminium, magnesium, carbides, nitrites and mixtures thereof.

Preferably, the heat source of smoking articles according to the invention is a carbonaceous combustible heat source.

As used herein, the term "carbonaceous" is used to describe a heat source comprising carbon. Preferably, carbonaceous combustible heat sources according to the invention have a carbon content of at least about 35 percent, more preferably of at least about 40 percent, most preferably of at least about 45 percent by dry weight of the combustible heat source.

In some embodiments, the heat source of smoking articles according to the invention is a combustible carbon-based heat source. As used herein, the term 'carbon-based heat source' is used to describe a heat source comprised primarily of carbon.

Combustible carbon-based heat sources for use in smoking articles according to the invention may have a carbon content of at least about 50 percent, preferably of at least about 60 percent, more preferably of at least about 70 percent, most preferably of at least about 80 percent by dry weight of the combustible carbon-based heat source.

Smoking articles according to the invention may comprise combustible carbonaceous heat sources formed from one or more suitable carbon-containing materials.

If desired, one or more binders may be combined with the one or more carbon-containing materials. Preferably, the one or more binders are organic binders. Suitable known organic binders, include but are not limited to, gums (for example, guar gum), modified celluloses and cellulose derivatives (for example, methyl cellulose, carboxymethyl cellulose, hydroxypropyl cellulose and hydroxypropyl methylcellulose) flour, starches, sugars, vegetable oils and combinations thereof.

In one preferred embodiment, the combustible heat source is formed from a mixture of carbon powder, modified cellulose, flour and sugar.

Instead of, or in addition to one or more binders, combustible heat sources for use in smoking articles according to the invention may comprise one or more additives in order to improve the properties of the combustible heat source. Suitable additives include, but are not limited to, additives to promote consolidation of the combustible heat source (for example, sintering aids), additives to promote ignition of the combustible heat source (for example, oxidisers such as perchlorates, chlorates, nitrates, peroxides, permanganates, and/or zirconium), additives to promote combustion of the combustible heat source (for example, potassium and potassium salts, such as potassium citrate) and additives to promote decomposition of one or more gases produced by combustion of the combustible heat source (for example catalysts, such as CuO, $Fe_2O_3$ and $Al_2O_3$).

Combustible carbonaceous heat sources for use in smoking articles according to the invention are preferably formed by mixing one or more carbon-containing materials with one or more binders and other additives, where included, and pre-forming the mixture into a desired shape. The mixture of one or more carbon containing materials, one or more binders and optional other additives may be pre-formed into a desired shape using any suitable known ceramic forming methods such as, for example, slip casting, extrusion, injection moulding and die compaction. In certain preferred embodiments, the mixture is pre-formed into a desired shape by extrusion.

Preferably, the mixture of one or more carbon-containing materials, one or more binders and other additives is pre-formed into an elongate rod. However, it will be appreciated that the mixture of one or more carbon-containing materials, one or more binders and other additives may be pre-formed into other desired shapes.

After formation, particularly after extrusion, the elongate rod or other desired shape is preferably dried to reduce its moisture content and then pyrolysed in a non-oxidizing atmosphere at a temperature sufficient to carbonise the one or more binders, where present, and substantially eliminate any volatiles in the elongate rod or other shape. The elongate rod or other desired shape is pyrolysed, preferably in a nitrogen atmosphere at a temperature of between about 700° C. and about 900° C.

The combustible heat source preferably has a porosity of between about 20 percent and about 80 percent, more preferably of between about 20 percent and 60 percent. Even more preferably, the combustible heat source has a porosity of between about 50 percent and about 70 percent, more preferably of between about 50 percent and about 60 percent as measured by, for example, mercury porosimetry or helium pycnometry. The required porosity may be readily achieved during production of the combustible heat source using conventional methods and technology.

Advantageously, combustible carbonaceous heat sources for use in smoking articles according to the invention have an apparent density of between about 0.6 $g/cm^3$ and about 1 $g/cm^3$.

Preferably, the combustible heat source has a mass of between about 300 mg and about 500 mg, more preferably of between about 400 mg and about 450 mg.

Preferably, the combustible heat source has a length of between about 7 mm and about 17 mm, more preferably of between about 7 mm and about 15 mm, most preferably of between about 7 mm and about 13 mm.

Preferably, the combustible heat source has a diameter of between about 5 mm and about 9 mm, more preferably of between about 7 mm and about 8 mm.

Preferably, the combustible heat source is of substantially uniform diameter. However, the combustible heat source may alternatively be tapered so that the diameter of the rear portion of the combustible heat source is greater than the diameter of the front portion thereof. Particularly preferred are combustible heat sources that are substantially cylindrical. The combustible heat source may, for example, be a cylinder or tapered cylinder of substantially circular cross-section or a cylinder or tapered cylinder of substantially elliptical cross-section.

Smoking articles according to the invention will include one or more airflow pathways along which air can be drawn through the smoking article for inhalation by a user.

In certain embodiments of the invention, the heat source comprises at least one longitudinal airflow channel, which provides one or more airflow pathways through the heat source. The term "airflow channel" is used herein to describe a channel extending along the length of the heat source through which air may be drawn through the smoking article for inhalation by a user. Such heat sources including one or more longitudinal airflow channels are referred to herein as "non-blind" heat sources.

The diameter of the at least one longitudinal airflow channel may be between about 1.5 mm and about 3 mm, more preferably between about 2 mm and about 2.5 mm. The inner surface of the at least one longitudinal airflow channel may be partially or entirely coated, as described in more detail in WO-A-2009/022232.

In alternative embodiments of the invention, no longitudinal airflow channels are provided in the heat source so that air drawn through the smoking article does not pass through any airflow channels along the heat source. Such heat sources are referred to herein as "blind" heat sources. Smoking articles including blind heat sources define alternative airflow pathways through the smoking article.

In smoking articles according to the invention comprising blind heat sources, heat transfer from the heat source to the aerosol-forming substrate occurs primarily by conduction and heating of the aerosol-forming substrate by convection is minimised or reduced. It is therefore particularly important with blind heat sources to optimise the conductive heat transfer between the heat source and the aerosol-forming substrate. The use of a second heat-conducting element has been found to have a particularly advantageous effect on the smoking performance of smoking articles including blind heat sources, where there is little if any compensatory heating effect due to convection.

Preferably, smoking articles according to the invention comprise aerosol-forming substrates comprising at least one aerosol-former and a material capable of emitting volatile compounds in response to heating.

The at least one aerosol former may be any suitable known compound or mixture of compounds that, in use, facilitates formation of a dense and stable aerosol. The aerosol former is preferably resistant to thermal degradation at the operating temperature of the smoking article. Suitable aerosol-formers are well known in the art and include, for example, polyhydric alcohols, esters of polyhydric alcohols, such as glycerol mono-, di- or triacetate, and aliphatic esters of mono-, di- or polycarboxylic acids, such as dimethyl dodecanedioate and dimethyl tetradecanedioate. Preferred aerosol formers for use in smoking articles according to the invention are polyhydric alcohols or mixtures thereof, such as triethylene glycol, 1,3-butanediol and, most preferred, glycerine.

Preferably, the material capable of emitting volatile compounds in response to heating is a charge of plant-based material, more preferably a charge of homogenised plant-based material. For example, the aerosol-forming substrate may comprise one or more materials derived from plants including, but not limited to: tobacco; tea, for example green tea; peppermint; laurel; eucalyptus; basil; sage; verbena; and tarragon. The plant based-material may comprise additives including, but not limited to, humectants, flavourants, binders and mixtures thereof. Preferably, the plant-based material consists essentially of tobacco material, most preferably homogenised tobacco material.

Preferably, the aerosol-forming substrate has a length of between about 5 mm and about 20 mm, more preferably of between about 8 mm and about 12 mm. Preferably, the front portion of the aerosol-forming substrate surrounded by the first heat-conducting element is between about 2 mm and about 10 mm in length, more preferably between about 3 mm and about 8 mm in length, most preferably between about 4 mm and about 6 mm in length. Preferably, the rear portion of the aerosol-forming substrate not surrounded by the first heat-conducting element is between about 3 mm and about 10 mm in length. In other words, the aerosol-forming substrate preferably extends between about 3 mm and about 10 mm downstream beyond the first heat-conducting element. More preferably, the aerosol-forming substrate extends at least about 4 mm downstream beyond the first heat-conducting element.

The heat source and aerosol-forming substrate of smoking articles according to the invention may substantially abut one another. Alternatively, the heat source and aerosol-forming substrate of smoking articles according to the invention may be longitudinally spaced apart from one another one another.

Preferably smoking articles according to the invention comprise an airflow directing element downstream of the aerosol-forming substrate. The airflow directing element defines an airflow pathway through the smoking article. At least one air inlet is preferably provided between a downstream end of the aerosol-forming substrate and a downstream end of the airflow directing element. The airflow directing element directs the air from the at least one inlet towards the mouth end of the smoking article.

The airflow directing element may comprise an open-ended, substantially air impermeable hollow body. In such embodiments, the air drawn in through the at least one air inlet is first drawn upstream along the exterior portion of the open-ended, substantially air impermeable hollow body and then downstream through the interior of the open-ended, substantially air impermeable hollow body.

The substantially air impermeable hollow body may be formed from one or more suitable air impermeable materials that are substantially thermally stable at the temperature of the aerosol generated by the transfer of heat from the heat source to the aerosol-forming substrate. Suitable materials are known in the art and include, but are not limited to, cardboard, plastic, ceramic and combinations thereof.

In one preferred embodiment, the open-ended, substantially air impermeable hollow body is a cylinder, preferably a right circular cylinder.

In another preferred embodiment, the open-ended, substantially air impermeable hollow body is a truncated cone, preferably a truncated right circular cone.

The open-ended, substantially air impermeable hollow body may have a length of between about 7 mm and about 50 mm, for example a length of between about 10 mm and about 45 mm or between about 15 mm and about 30 mm. The airflow directing element may have other lengths depending upon the desired overall length of the smoking article, and the presence and length of other components within the smoking article.

Where the open-ended, substantially air impermeable hollow body is a cylinder, the cylinder may have a diameter of between about 2 mm and about 5 mm, for example a diameter of between about 2.5 mm and about 4.5 mm. The cylinder may have other diameters depending on the desired overall diameter of the smoking article.

Where the open-ended, substantially air impermeable hollow body is a truncated cone, the upstream end of the truncated cone may have a diameter of between about 2 mm and about 5 mm, for example a diameter of between about 2.5 mm and about 4.5 mm. The upstream end of the truncated cone may have other diameters depending on the desired overall diameter of the smoking article.

Where the open-ended, substantially air impermeable hollow body is a truncated cone, the downstream end of the truncated cone may have a diameter of between about 5 mm and about 9 mm, for example of between about 7 mm and about 8 mm. The downstream end of the truncated cone may have other diameters depending on the desired overall diameter of the smoking article. Preferably, the downstream end of the truncated cone is of substantially the same diameter as the aerosol-forming substrate.

The open-ended, substantially air impermeable hollow body may abut the aerosol-forming substrate. Alternatively, the open-ended, substantially air impermeable hollow body may extend into the aerosol-forming substrate. For example, in certain embodiments the open-ended, substantially air impermeable hollow body may extend a distance of up to 0.5 L into the aerosol-forming substrate, where L is the length of the aerosol-forming substrate.

The upstream end of the substantially air impermeable hollow body is of reduced diameter compared to the aerosol-forming substrate.

In certain embodiments, the downstream end of the substantially air impermeable hollow body is of reduced diameter compared to the aerosol-forming substrate.

In other embodiments, the downstream end of the substantially air impermeable hollow body is of substantially the same diameter as the aerosol-forming substrate.

Where the downstream end of the substantially air impermeable hollow body is of reduced diameter compared to the aerosol-forming substrate, the substantially air impermeable hollow body may be circumscribed by a substantially air impermeable seal. In such embodiments, the substantially air impermeable seal is located downstream of the one or more air inlets. The substantially air impermeable seal may be of substantially the same diameter as the aerosol-forming substrate. For example, in some embodiments the downstream end of the substantially air impermeable hollow body may be circumscribed by a substantially impermeable plug or washer of substantially the same diameter as the aerosol-forming substrate.

The substantially air impermeable seal may be formed from one or more suitable air impermeable materials that are substantially thermally stable at the temperature of the aerosol generated by the transfer of heat from the combustible heat source to the aerosol-forming substrate. Suitable materials are known in the art and include, but are not limited to, cardboard, plastic, wax, silicone, ceramic and combinations thereof.

At least a portion of the length of the open-ended, substantially air impermeable hollow body may be circumscribed by an air permeable diffuser. The air permeable diffuser may be of substantially the same diameter as the aerosol-forming substrate. The air permeable diffuser may be formed from one or more suitable air permeable materials that are substantially thermally stable at the temperature of the aerosol generated by the transfer of heat from the combustible heat source to the aerosol-forming substrate. Suitable air permeable materials are known in the art and include, but are not limited to, porous materials such as, for example, cellulose acetate tow, cotton, open-cell ceramic and polymer foams, tobacco material and combinations thereof.

In one preferred embodiment, the airflow directing element comprises an open ended, substantially air impermeable, hollow tube of reduced diameter compared to the aerosol-forming substrate and an annular, substantially air impermeable seal of substantially the same outer diameter as the aerosol-forming substrate, which circumscribes a downstream end of the hollow tube.

The airflow directing element may further comprise an inner wrapper, which circumscribes the hollow tube and the annular substantially air impermeable seal.

The open upstream end of the hollow tube may abut a downstream end of the aerosol-forming substrate. Alternatively, the open upstream end of the hollow tube may be inserted or otherwise extend into the downstream end of the aerosol-forming substrate.

The airflow directing element may further comprise an annular air permeable diffuser of substantially the same outer diameter as the aerosol-forming substrate, which circumscribes at least a portion of the length of the hollow tube upstream of the annular substantially air impermeable seal. For example, the hollow tube may be at least partially embedded in a plug of cellulose acetate tow.

In another preferred embodiment, the airflow directing element comprises: an open ended, substantially air impermeable, truncated hollow cone having an upstream end of reduced diameter compared to the aerosol-forming substrate and a downstream end of substantially the same diameter as the aerosol-forming substrate.

The open upstream end of the truncated hollow cone may abut a downstream end of the aerosol-forming substrate. Alternatively, the open upstream end of the truncated hollow cone may be inserted or otherwise extend into the downstream end of the aerosol-forming substrate.

The airflow directing element may further comprise an annular air permeable diffuser of substantially the same outer diameter as the aerosol-forming substrate, which circumscribes at least a portion of the length of the truncated hollow cone. For example, the truncated hollow cone may be at least partially embedded in a plug of cellulose acetate tow.

Smoking articles according to the invention preferably further comprise an expansion chamber downstream of the aerosol-forming substrate and, where present, downstream of the airflow directing element. The inclusion of an expansion chamber advantageously allows further cooling of the aerosol generated by heat transfer from the heat source to the aerosol-forming substrate. The expansion chamber also advantageously allows the overall length of smoking articles according to the invention to be adjusted to a desired value, for example to a length similar to that of conventional cigarettes, through an appropriate choice of the length of the expansion chamber. Preferably, the expansion chamber is an elongate hollow tube.

Smoking articles according to the invention may also further comprise a mouthpiece downstream of the aerosol-forming substrate and, where present, downstream of the airflow directing element and expansion chamber. The mouthpiece may, for example, comprise a filter made of cellulose acetate, paper or other suitable known filtration materials. Preferably, the mouthpiece is of low filtration efficiency, more preferably of very low filtration efficiency. Alternatively or in addition, the mouthpiece may comprise one or more segments comprising absorbents, adsorbents, flavourants, and other aerosol modifiers and additives which are used in filters for conventional cigarettes, or combinations thereof.

Smoking articles according to the invention may be assembled using known methods and machinery.

The invention will be further described, by way of example only, with reference to the accompanying drawings in which.

Figure 1:
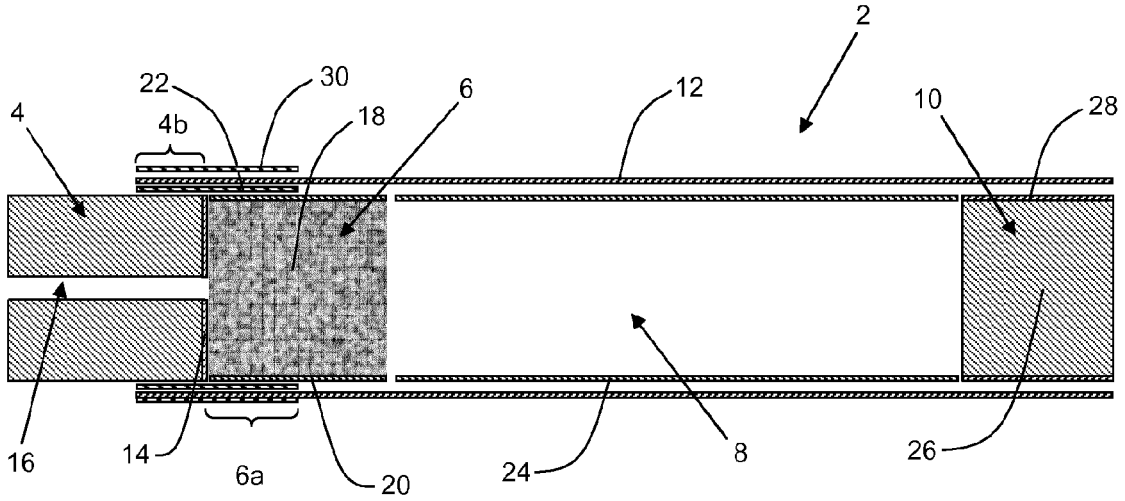
FIG. 1 shows a schematic longitudinal cross-section of a smoking article according to a first embodiment of the invention.

The smoking article 2 shown in FIG. 1 comprises a combustible carbonaceous heat source 4, an aerosol-forming substrate 6, an elongate expansion chamber 8 and a mouthpiece 10 in abutting coaxial alignment. The combustible carbonaceous heat source 4, aerosol-forming substrate 6, elongate expansion chamber 8 and mouthpiece 10 are overwrapped in an outer wrapper of cigarette paper 12 of low air permeability.

As shown in FIG. 1, a non-combustible, gas-resistant, first barrier coating 14 is provided on substantially the entire rear face of the combustible carbonaceous heat source 4. In an alternative embodiment, a non-combustible, substantially air impermeable first barrier is provided in the form of a disc that abuts the rear face of the combustible carbonaceous heat source 4 and the front face of the aerosol-forming substrate 6.

The combustible carbonaceous heat source 4 is a non-blind heat source and comprises a central airflow channel 16 that extends longitudinally through the combustible carbonaceous heat source 4 and the non-combustible, gas-resistant, first barrier coating 14. A gas-resistant, heat resistant, second barrier coating (not shown) is provided on the inner surface of the central airflow channel 16.

The aerosol-forming substrate 6 is located immediately downstream of the combustible carbonaceous heat source 4 and comprises a cylindrical plug of tobacco material 18 comprising glycerine as aerosol former and circumscribed by filter plug wrap 20.

A first heat-conducting element 22 consisting of a tube of aluminium foil surrounds and is in contact with a rear portion 4*b* of the combustible carbonaceous heat source 4 and an abutting front portion 6*a* of the aerosol-forming substrate 6. As shown in FIG. 1, a rear portion of the aerosol-forming substrate 6 is not surrounded by the first heat-conducting element 22.

The elongate expansion chamber 8 is located downstream of the aerosol-forming substrate 6 and comprises a cylindrical open-ended tube of cardboard 24. The mouthpiece 10 of the smoking article 2 is located downstream of the expansion chamber 8 and comprises a cylindrical plug of cellulose acetate tow 26 of very low filtration efficiency circumscribed by filter plug wrap 28. The mouthpiece 10 may be circumscribed by tipping paper (not shown).

A second heat-conducting element 30 consisting of a tube of aluminium foil surrounds and is in contact with the outer wrapper 12. The second heat-conducting element 30 is positioned over the first heat-conducting element 22 and is of the same dimensions as the first heat-conducting element 22. The second heat-conducting element 30 therefore directly overlies the first heat-conducting element 22, with the outer wrapper 12 between them.

In use, the user ignites the combustible carbonaceous heat source 4 and then draws air through the central airflow channel 16 downstream towards the mouthpiece 10. The front portion 6*a* of the aerosol-forming substrate 6 is heated primarily by conduction through the abutting non-combusting rear portion 4*b* of the combustible carbonaceous heat source 4 and the first heat-conducting element 22. The drawn air is heated as it passes through the central airflow channel 16 of the combustible carbonaceous heat source 4 and then heats the aerosol-forming substrate 6 by convection. The heating of the aerosol-forming substrate 6 releases volatile and semi-volatile compounds and glycerine from the tobacco material 18, which are entrained in the heated drawn air as it flows through the aerosol-forming substrate 6. The heated air and entrained compounds pass downstream through the expansion chamber 8, cool and condense to form an aerosol that passes through the mouthpiece 10 into the mouth of the user).

The second heat-conducting element 30 retains heat within the smoking article 2 to help maintain the temperature of the first heat-conducting element 22 during smoking. This in turn helps maintain the temperature of the aerosol-forming substrate 6 to facilitate continued and enhanced aerosol delivery.

Figure 2:
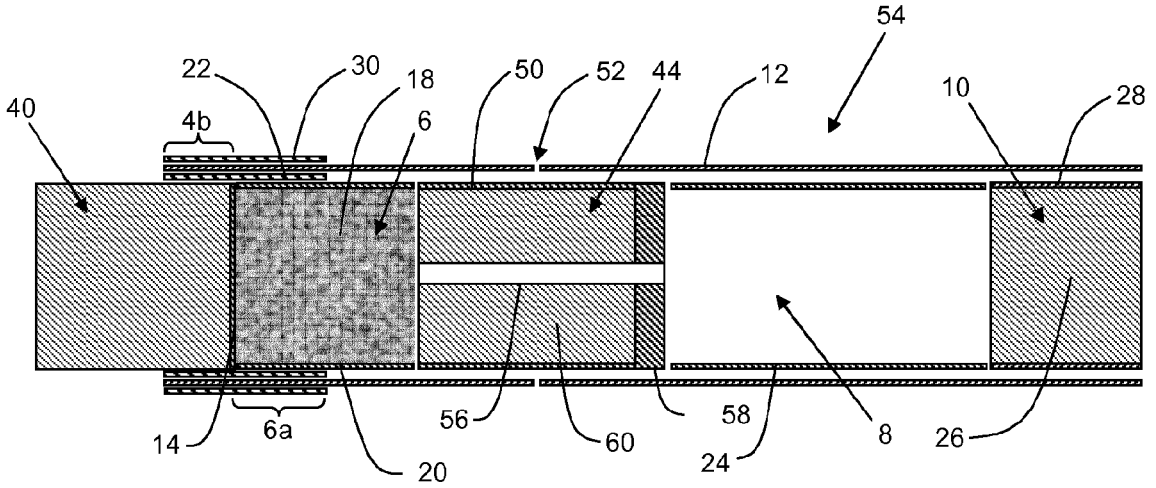
FIG. 2 shows a schematic longitudinal cross-section of a smoking article according to a second embodiment of the invention.

The smoking article 54 according to the second embodiment of the invention shown in FIG. 2 comprises a combustible carbonaceous heat source 40, an aerosol-forming substrate 6, an airflow directing element 44, an elongate expansion chamber 8 and a mouthpiece 10 in abutting coaxial alignment. The combustible carbonaceous heat source 40, aerosol-forming substrate 6, airflow directing element 44, elongate expansion chamber 8 and mouthpiece 10 are overwrapped in an outer wrapper of cigarette paper 12 of low air permeability.

As shown in FIG. 2, a non-combustible, substantially air impermeable, barrier coating 14 is provided on the entire rear face of the combustible carbonaceous heat source 40 of the smoking article 54. In an alternative embodiment, instead of a coating, a non-combustible, substantially air impermeable barrier is provided in the form of a disc that abuts the rear face of the combustible carbonaceous heat source 40 and the front face of the aerosol-forming substrate 6.

The combustible carbonaceous heat source 40 is a blind heat source and in the smoking article 54 according to the second embodiment, air drawn through the smoking article for inhalation by a user does not pass through any airflow channels along the combustible heat source 40.

The aerosol-forming substrate 6, expansion chamber 8 and mouthpiece 10 are of the same construction and function as described above in relation to the smoking article 2 of the first embodiment shown in FIG. 1.

As in the smoking article 2 of the first embodiment shown in FIG. 1, a first heat-conducting element 22 consisting of a tube of aluminium foil surrounds and is in contact with a rear portion 4*b* of the combustible carbonaceous heat source 40 and an abutting front portion 6*a* of the aerosol-forming substrate 6. A second heat-conducting element 30 consisting of a similar tube of aluminium foil is also provided as described above in relation to the smoking article 2 of the first embodiment shown in FIG. 1.

An airflow directing element 44 is located downstream of the aerosol-forming substrate 6 and comprises an open-ended, substantially air impermeable hollow tube 56 made of, for example, cardboard, which is of reduced diameter compared to the aerosol-forming substrate 6. The upstream end of the open-ended hollow tube 56 abuts the aerosol-forming substrate 6. The downstream end of the open-ended hollow tube 56 is surrounded by an annular substantially air impermeable seal 58 of substantially the same diameter as the aerosol-forming substrate 6. The remainder of the open-ended hollow tube is embedded in a cylindrical plug of cellulose acetate tow 60 of substantially the same diameter as the aerosol-forming substrate 6.

The open-ended hollow tube, 56 and cylindrical plug of cellulose acetate tow 60 are circumscribed by an air permeable inner wrapper 50.

As also shown in FIG. 2, a circumferential row of air inlets 52 are provided in the outer wrapper 12 circumscribing the inner wrapper 50.

In use, when a user draws on the mouthpiece 10, cool air is drawn into the smoking article 54 according to the second embodiment of the invention through the air inlets 52. The drawn air passes upstream between the exterior of the open-ended hollow tube 56 and the inner wrapper 50 through the cylindrical plug of cellulose acetate tow 60 to the aerosol-forming substrate 6.

As in the smoking article 2 according to the first embodiment of the invention shown in FIG. 1 and described above, the aerosol-forming substrate 6 is heated by conduction to form an aerosol that is entrained in the drawn air as it flows through the aerosol-forming substrate 6. The drawn air and entrained aerosol pass downstream through the interior of the hollow tube 56 of the airflow directing element 44 to the expansion chamber 8, where they cool and condense. The cooled aerosol then passes downstream through the mouthpiece 10 of the smoking article 54 into the mouth of the user.

The non-combustible, substantially air impermeable, barrier coating 14 provided on the entire rear face of the combustible carbonaceous heat source 40 isolates the combustible carbonaceous heat source 40 from the airflow pathways through the smoking article 54 such that, in use, air drawn through the smoking article 54 along the airflow pathways does not directly contact the combustible carbonaceous heat source 40.

The second heat-conducting element 30 retains heat within the smoking article 54, as described above in relation to the smoking article 2 of the first embodiment shown in FIG. 1.

Smoking articles according to the second embodiment of the invention shown in FIG. 2 were assembled from the components shown below in Table 1.

TABLE 1

| | |
|---|---|
| Smoking article | |
| Overall length (mm) | 84 |
| Diameter (mm) | 7.8 |
| Porous carbonaceous heat source | |
| Length (mm) | 8 |
| Diameter (mm) | 7.8 |
| Thickness of first barrier coating (microns) | ≤500 |
| Aerosol-forming substrate | |
| Length (mm) | 10 |
| Diameter (mm) | 7.8 |
| Density (g/cm$^3$) | 0.73 |
| Aerosol former | Glycerine |
| Amount of aerosol former | 20% by dry wt. of tobacco |
| Airflow directing element | |
| Length (mm) | 26 |
| Diameter (mm) | 7.8 |
| Length of plug of porous material (mm) | 24 |
| Diameter of hollow tube (mm) | 3.5 |
| Number of air inlets | 4-8 |
| Diameter of air inlets (mm) | 0.2 |
| Distance of air inlets from upstream end (mm) | 24 |
| Expansion chamber | |
| Length (mm) | 33 |
| Diameter (mm) | 7.8 |
| Mouthpiece | |
| Length (mm) | 7 |
| Diameter (mm) | 7.8 |
| Heat-conducting elements | |
| Length (mm) | 8 |
| Diameter (mm) | 7.8 |
| Thickness of aluminium foil (microns) | 20 |
| Length of rear portion of combustible carbonaceous heat source (mm) | 4 |
| Length of front portion of aerosol-forming substrate (mm) | 4 |
| Length of rear portion of aerosol-forming substrate (mm) | 6 |

Figure 3:
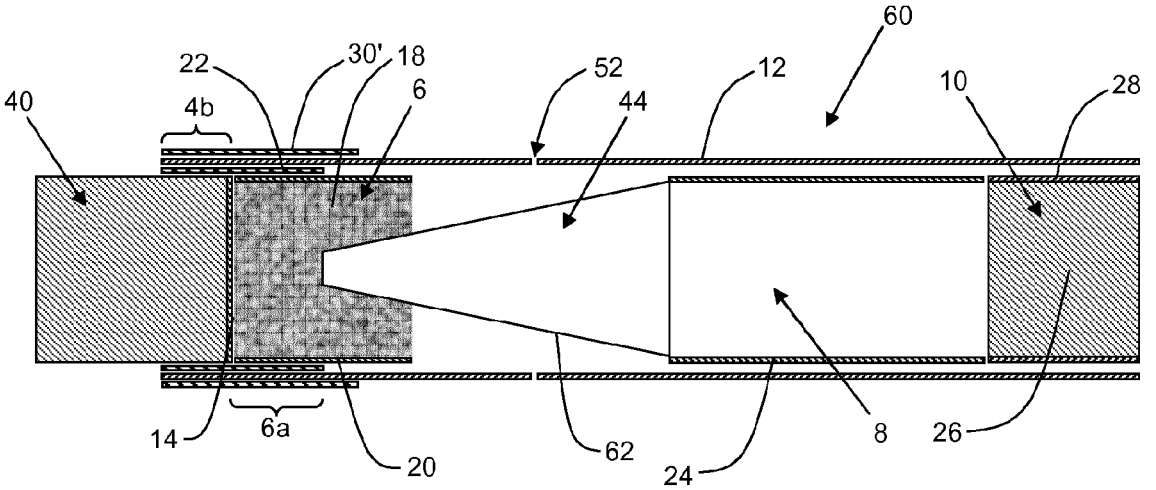
FIG. 3 shows a schematic longitudinal cross-section of a smoking article according to a third embodiment of the invention.

The smoking article 60 according to the third embodiment of the invention shown in FIG. 3 is of similar construction to the smoking article 54 according to the second embodiment of the invention shown in FIG. 2. However, the smoking article 60 shown in FIG. 3 differs from the smoking article 54 shown in FIG. 2 in the construction of the airflow directing element 44, as described below. In addition, unlike in the smoking article 54 shown in FIG. 2, the second heat-conducting element 30' of the smoking article 60 extends about 3 mm beyond the first heat-conducting element 22 in a downstream direction. The second heat-conducting element 30' therefore covers a larger proportion of the aerosol-forming substrate 6.

In the third embodiment of the invention, the airflow directing element 44 comprises an axial, open-ended, substantially air impermeable, truncated cone 62, which is positioned centrally within the smoking article 60. The downstream end of the hollow cone 62 is of substantially the same diameter as the aerosol-forming substrate 6 and the upstream end of the hollow cone 62 is of reduced diameter compared to the aerosol-forming substrate 6. The hollow cone 62 may be formed from any suitable air impermeable material including, but not limited to, cardboard, plastic and combinations thereof.

The upstream end of the substantially air impermeable, truncated hollow cone 62 extends into the aerosol-forming substrate 6.

A circumferential row of air inlets 52 is provided in the outer wrapper 12 circumscribing the hollow cone 62, downstream of the aerosol-forming substrate 6.

In use, when a user draws on the mouthpiece 10 of the smoking article 60 according to the third embodiment of the invention, cool air is drawn into the smoking article 60 through the air inlets 52. The cool air passes upstream between the outer wrapper 12 and the exterior of the hollow cone 62 of the airflow directing element 44 into the aerosol-forming substrate 6.

As in the smoking article 54 according to the second embodiment of the invention shown in FIG. 2 and described above, the aerosol-forming substrate 6 is heated by conduction to form an aerosol that is entrained in the drawn air as it flows through the aerosol-forming substrate 6. The drawn air and entrained aerosol pass downstream along through the interior of the hollow cone 62 of the airflow directing element 44 to the expansion chamber 8, where they cool and condense. The cooled aerosol then passes downstream through the mouthpiece 10 of the smoking article 60 into the mouth of the user.

The second heat-conducting element 30' retains heat within the smoking article 54, as described above in relation to the smoking article 2 of the first embodiment shown in FIG. 1. In addition, the second heat-conducting element 30' transfers heat along the aerosol-forming substrate 6, beyond the downstream end of the first heat-conducting element 22. The heat is therefore dispersed through a larger volume of the aerosol-forming substrate 6 and a more consistent puff-by-puff aerosol delivery is provided, as described above.

It has been found that during smoking of the smoking article 60 of the third embodiment shown in FIG. 3, the temperature of the rear portion 4*b* of the combustible heat source 40 (as measured by a thermocouple provided at approximately 1 mm from the downstream end of the combustible heat source 40) is approximately 50° C. higher than the corresponding temperature in an identical smoking article without the second heat-conducting element 30'. It has further been found that the temperature of the front portion of the aerosol-forming substrate 6 (as measured by a thermocouple provided at approximately 2 mm from the upstream end of the aerosol-forming substrate 6) is between 20° C. and 50° C. higher than the corresponding temperature in an identical smoking article without the second heat-conducting element 30'.

It has further been found that the smoking duration of the smoking article 60 of the third embodiment of the invention is increased by approximately 1 minute, or 2 puffs, compared to the smoking duration for an identical smoking article without the second heat-conducting element 30'.

It has further been found that the smoking article 60 of the third embodiment of the invention delivers approximately 25 percent more nicotine during smoking compared to an identical smoking article without the second heat-conducting element. Similarly, the smoking article 60 has been found to deliver approximately 30 percent more glycerine during smoking compared to an identical smoking article without the second heat-conducting element 30'.

Smoking articles according to the third embodiment may be assembled from the individual components described, the parameters of which may be determined by analogy with the information provided in Table 1 for the second embodiment.

The embodiments shown in FIGS. 1 to 3 and described above illustrate but do not limit the invention. Other embodiments of the invention may be made without departing from the spirit and scope thereof, and it is to be understood that the specific embodiments described herein are not limiting.

The invention claimed is:

1. A smoking article, comprising:

a blind combustible heat source in which no longitudinal airflow channels are provided in the heat source, such that air drawn through the smoking article does not pass through any airflow channels along the heat source;

an aerosol-forming substrate downstream of the blind combustible heat source;

an airflow directing element downstream of the aerosol-forming substrate;

at least one air inlet between a downstream end of the aerosol-forming substrate and a downstream end of the airflow directing element;

a first heat-conducting element around and in contact with a rear portion of the blind combustible heat source and an adjacent front portion of the aerosol-forming substrate; and a second heat-conducting element around at least a portion of the first heat-conducting element, wherein at least part of the second heat-conducting element is radially separated from the first heat-conducting element.

2. The smoking article according to claim 1, wherein all of the second heat-conducting element is radially separated from the first heat-conducting element such that there is no direct contact between the first and second heat-conducting elements.

3. The smoking article according to claim 1, wherein the first heat-conducting element and the second heat-conducting element are radially separated by at least one layer of a heat-insulating material.

4. The smoking article according to claim 3, wherein the heat-insulating material is a paper wrapper.

5. The smoking article according to claim 1, wherein the second heat-conducting element comprises one or more layers of a heat-reflective material.

6. The smoking article according to claim 1, wherein the second heat-conducting element comprises one or more layers of aluminium.

7. The smoking article according to claim 1, wherein the second heat-conducting element overlies at least a portion of the aerosol-forming substrate and at least a portion of the heat source.

8. The smoking article according to claim 1, wherein the second heat-conducting element has a maximum thickness of 5 microns to 50 microns.

9. The smoking article according to claim 1, wherein the first heat-conducting element and the second heat-conducting element are radially separated by at least 50 microns.

10. The smoking article according to claim 1, further comprising an outer paper wrapper around the second heat-conducting element.

11. The smoking article according to claim 1, wherein the second heat-conducting element is formed of a laminate material comprising one or more layers of a heat-conducting material.

12. The smoking article according to claim 1, wherein the second heat-conducting element extends beyond the first heat-conducting element in a downstream direction.

13. The smoking article according to claim 1, wherein the upstream edges of the first heat-conducting element and the second heat-conducting element are substantially aligned.

14. A method of adjusting the puff-by-puff aerosol delivery of a smoking article during puffing, the method comprising providing a smoking article according to claim 1 and adjusting the amount by which the second heat-conducting element extends beyond the first heat-conducting element in a downstream direction, over the aerosol-forming substrate.

15. The smoking article according to claim 1, wherein the second heat-conducting element includes steel.

16. The smoking article according to claim 1, wherein the airflow directing element comprises an open-ended, substantially air impermeable hollow body, whereby in use air drawn into the smoking article through the at least one air inlet is first drawn upstream along an exterior portion of the open-ended, substantially air impermeable hollow body to the aerosol-forming substrate and then downstream through an interior of the open-ended, substantially air impermeable hollow body.

* * * * *